US006109057A

United States Patent [19]

Shervington et al.

[11] Patent Number: 6,109,057

[45] Date of Patent: Aug. 29, 2000

[54] APPARATUS FOR COOLING AND/OR GASSIFYING A LIQUID

[75] Inventors: Evelyn Arthur Shervington, Sourth Harting Near Petersfield; Michael Ernest Garrett, Woking, both of United Kingdom

[73] Assignee: The BOC Group plc, Windlesham, United Kingdom

[21] Appl. No.: 09/194,958

[22] PCT Filed: Jan. 8, 1997

[86] PCT No.: PCT/GB97/00045

§ 371 Date: Mar. 31, 1999

§ 102(e) Date: Mar. 31, 1999

[87] PCT Pub. No.: WO97/47932

PCT Pub. Date: Dec. 18, 1997

[30] Foreign Application Priority Data

Jun. 10, 1996 [GB] United Kingdom ..... 9612125

[51] Int. Cl.[7] ..... F25D 3/08

[52] U.S. Cl. ..... 62/371; 62/480; 62/294; 62/293; 62/457.3

[58] Field of Search ..... 62/371, 480, 294, 62/293, 457.3

[56] References Cited

U.S. PATENT DOCUMENTS

| | | | |
|---|---|---|---|
| 4,736,599 | 4/1988 | Siegel | 62/480 |
| 4,928,495 | 5/1990 | Siegel | 62/480 |
| 5,079,932 | 1/1992 | Siegel | 62/480 |
| 5,154,067 | 10/1992 | Tomizawa et al. | 62/480 |
| 5,692,381 | 12/1997 | Garrett | 62/480 |
| 5,732,569 | 3/1998 | Sanada et al. | 62/480 |

*Primary Examiner*—Henry Bennett
*Assistant Examiner*—Mark Shulman
*Attorney, Agent, or Firm*—Salvatore P. Pace

[57] ABSTRACT

The present invention provides an apparatus for cooling and/or gassifying a liquid 12 stored in a container 10 having an outlet 10*b*. The apparatus comprises an adsorbent 14 for receiving and adsorbing under pressure a quantity of gas and a three position cap 16. In a first position, said cap 16 simply acts to seal the contents within the container whilst in a second position it acts to cause release of adsorbed gas from adsorbent 14 which then passes through the beverage 12 thereby gassifying and/or cooling said beverage. A third position of the cap 16 allows for its removal from container 10 such that the beverage may be dispensed. The container may be provided with a thermochromatic coating to indicate when the liquid is at a predetermined temperature.

25 Claims, 4 Drawing Sheets

FIG. 4
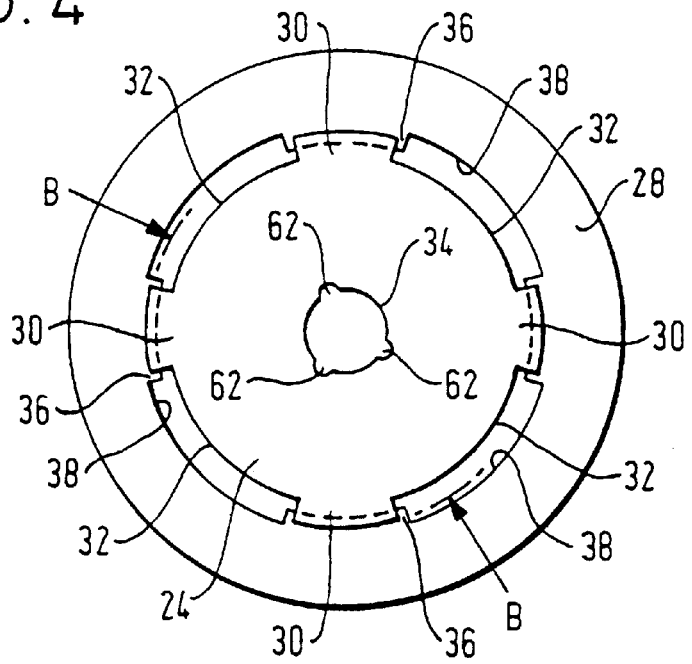
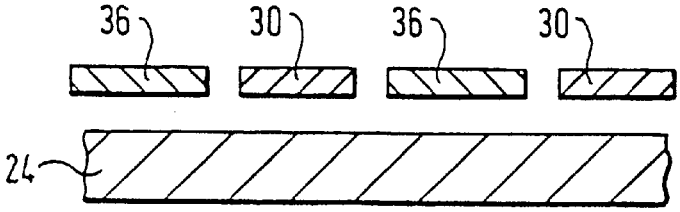
FIG. 5A
FIG. 5B
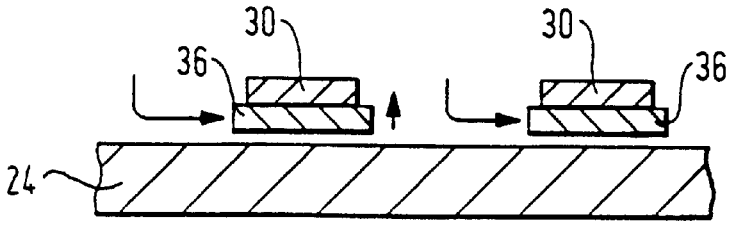
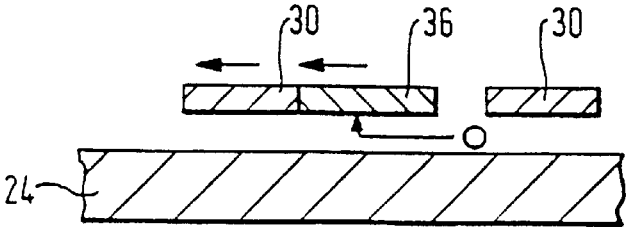
FIG. 5C

APPARATUS FOR COOLING AND/OR GASSIFYING A LIQUID

The present invention relates to an apparatus for cooling and/or gassifying a liquid stored in a container and relates particularly, but not exclusively, to such an arrangement suitable for treating a liquid beverage prior to dispensing.

GB-A-2280886 discloses a carbonated beverage container including a hollow insert having a one way valve through which gas is jetted into the beverage causing nucleation of fine bubbles which separate out to form a close-knit creamy head. The insert itself is designed to float on top of the beverage and may be made of plastic or metal. Such a system, whilst being able to gassify the liquid, is unable to provide a significant cooling effect. An alternative arrangement is shown in GB-A-2183592 in which a chamber is charged with a gas which is releasable into the beverage upon opening the ring-pull of the can. Once released, the gas acts to form a head of froth on the beverage before and during dispensing. Again, this arrangement is unable to provide a significant degree of cooling.

It is an object of the present invention to provide an apparatus capable of cooling as well as gassifying a liquid stored in a container.

Accordingly, the present invention provides an apparatus for cooling and/or gassifying a liquid stored in a container having an outlet, said apparatus comprising an absorbent, for receiving and adsorbing under pressure a quantity of gas; sealing means, for sealing said adsorbed gas in said adsorbent; and releasing means, for releasing adsorbed gas from said adsorbent in a controlled manner and directly into said liquid such that the released gas passes through the liquid thereby cooling and/or gassifying said liquid. It will be appreciated that the chilling effect is produced as a result of the desorption process.

The present invention will now be more particularly described by way of example only with reference to the following drawings, in which:

FIG. 4 is a view taken in the direction of arrows A—A in FIG. 1; and

FIGS. 5A, B and C are views taken in the direction of arrows B—B and illustrate the various steps involved in the operation of the cap.

Figure 1:
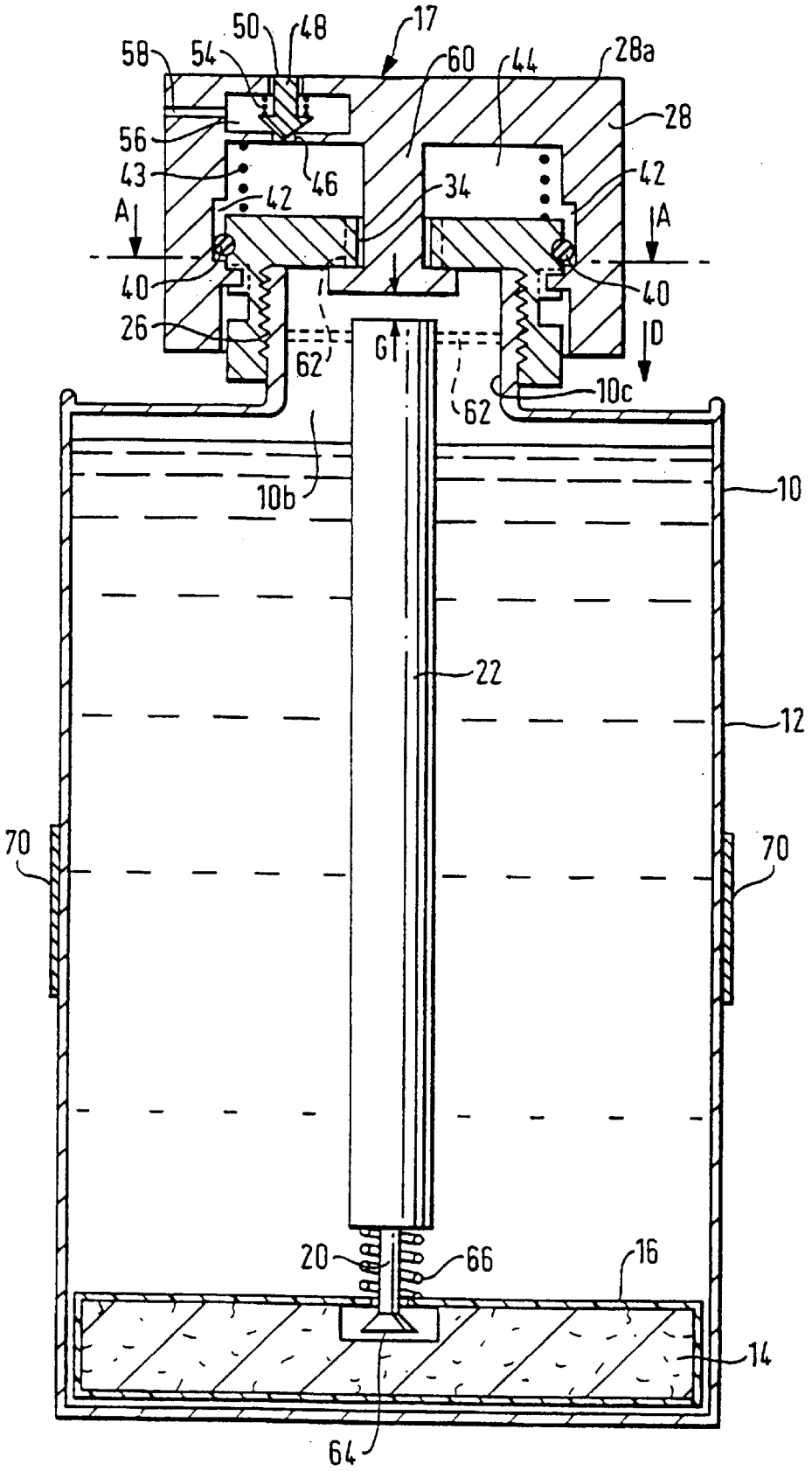
FIGS. 1–3 are cross-sectional views of the present invention and illustrate the operating sequence.
Figure 2:
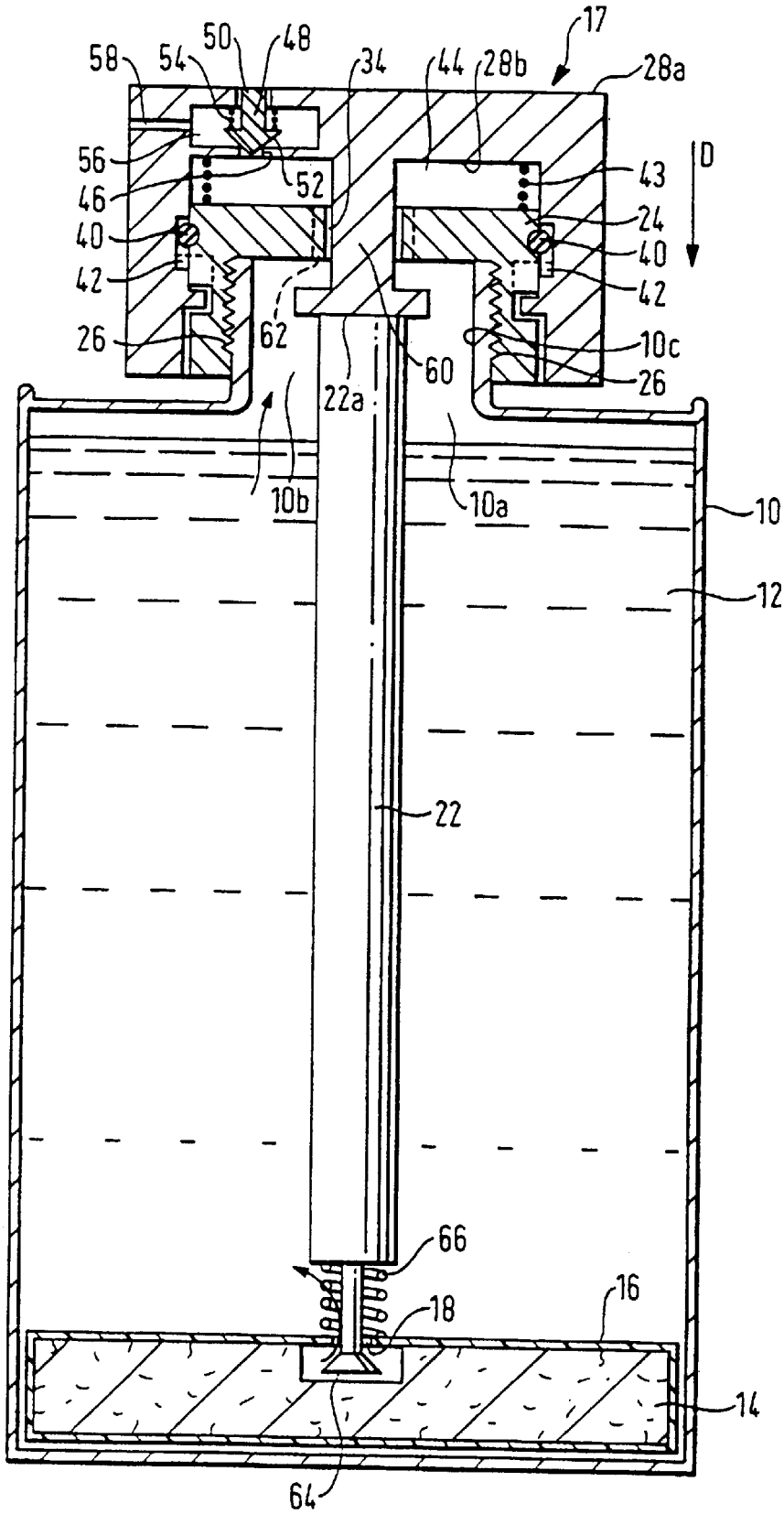
Figure 3:
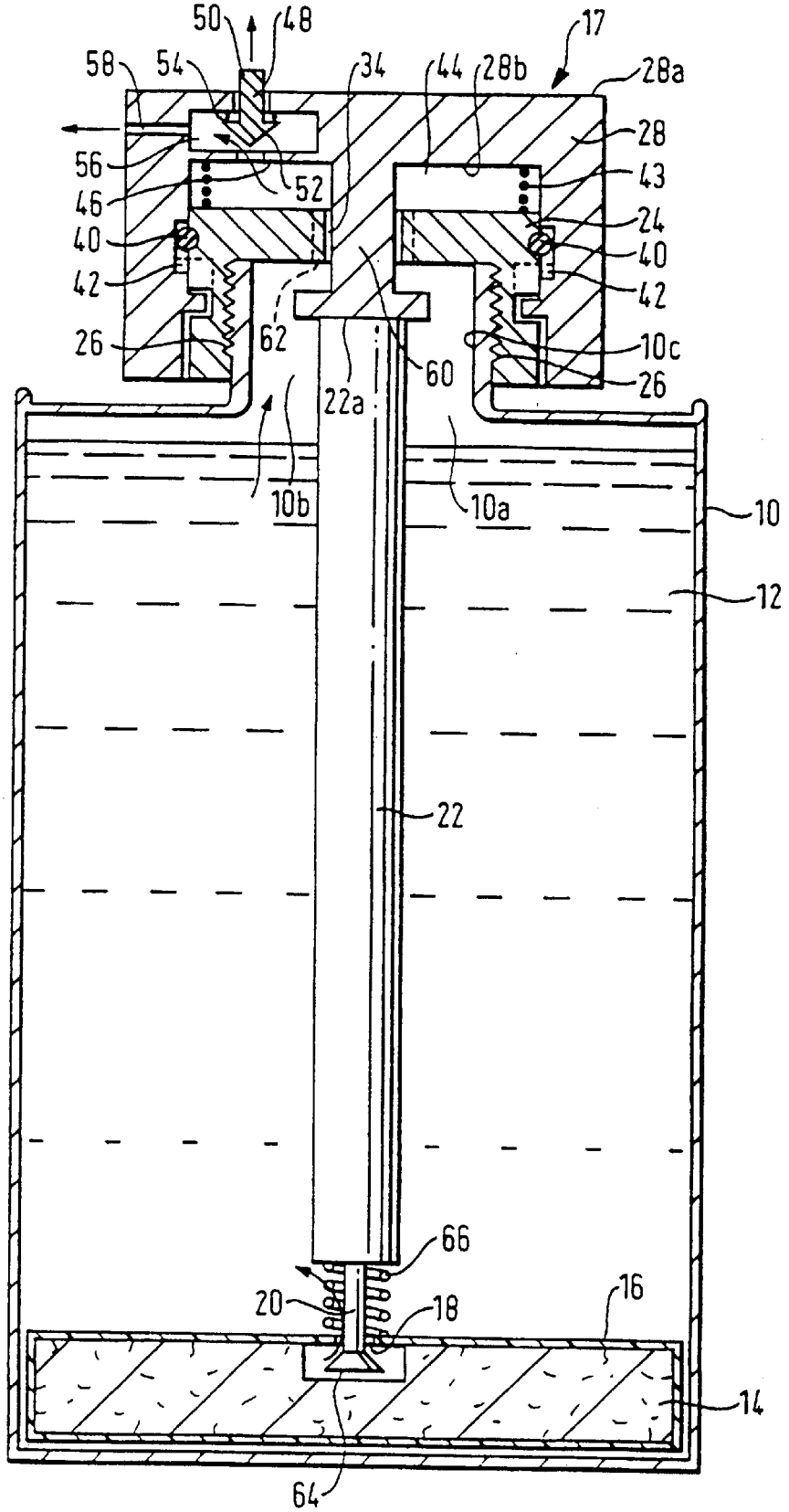

Referring now to the drawings in general but particularly to FIGS. 1–3, the present invention comprises a container 10 for storing a quantity of liquid 12 to be cooled and/or gassified before being dispensed, an adsorbent 14 for adsorbing gas such as, for example, carbon dioxide to be used during said cooling and/or gassifying process and a re-sealable cap shown generally at 17. The Adsorbent 14 is encased in an outer casing 16 formed of, for example plastic material. The casing 16 is provided with an outlet 18 and a releasing means in the form of re-sealable valve 20 for allowing or inhibiting the flow of adsorbed gas from the adsorbent. Valve 20 is operably connected to cap 17 via linking member 22 which extends through the body of liquid 12 within the container.

The cap itself comprises a first inner portion 24 releasably connected to the container by, for example, screw thread 26 and a second outer portion 28 operably connected to the first portion 24 in a manner to be described in detail later herein and moveable relative thereto between first, second and third positions illustrated by FIGS. 5A to 5C respectively. In more detail, the inner portion 24 includes a plurality of axially projecting and circumfrentially spaced detents 30 projecting from an outer surface 32 and a central aperture 34 the function of which will be described in detail later herein. The first detents 30 are spatially positioned for operable connection with corresponding second detents 36 projecting from an inner surface 38 of outer portion 28. The second detents 36 are moveable with the second portion of the cap between said first position (FIG. 5A) in which they lie between the first detents and are not engaged therewith, said second position (FIG. 5B) in which they are axially displaced relative to the first detents 30 and are engaged with and retained in said position by said first detents 30, and said third position in which said second detents abut against said first detents 30 and facilitate rotational movement thereof upon rotational movement of said second portion. This last position allows for removal of cap 17 from container 10. A seal shown in, for example, the form of an O ring 40 (best seen in FIGS. 1–3) is provided for sealing any gap between inner and outer portions 24,28 respectively. As shown in FIGS. 1–3, the seal is preferably located within a region having an axially extending groove 42 along which the seal may slide as outer portion 28 is moved between its axially displaced positions. A chamber 44 is formed between said first and said second cap portions 24, 28 and is operably linked for the flow of gas from the interior 10A of container 10 via aperture 34 in inner portion 24. A spring 43 biases the outer portion 28 away from the inner portion. The outer portion 28 is further provided with a gas outlet and pressure release valve 48 for allowing the flow of gas to atmosphere from within chamber 44. Whilst it will be appreciated that any one of a number of pressure release valves may be employed, applicants have found that a sprung loaded arrangement as illustrated in FIGS. 1–3 can be employed to give a visual indication of when the valve is open and, hence, gas is being vented to atmosphere. This arrangement includes a projection 50 which, in operation stands proud of an upper surface 28A of the cap whenever the valve is open. In this particular arrangement, the valve includes a valve seat 52 and is sprung loaded by spring 54 to bias the valve such that seat 52 obturates outlet 46 as shown in FIG. 1. In operation, gas pressure within chamber 44 acts to open valve 48 and allow excess gas to escape to atmosphere via chamber 56 and outlet 58. Outer portion 28 further includes an actuation means in the form of plunger 60 depending from bottom surface 28*b*. Plunger 60 extends through chamber 44 and opening 34 before terminating at a point adjacent an upper end 22*a* of link member 22. Aperture 34 is suitably sized so as to allow for the escape of gas between plunger 60 and inner portion 24. If necessary, a plurality of cut-outs 62 may be provided around aperture 34 so as to enlarge the gas escape path. Distal end of plunger 60 defines an abutment surface 60*a* for abutment against end 22*a* of link member 22.

In operation, a pellet of adsorbent 14 is deposited within the container 10 and link member 22 positioned for engagement with valve 20 and plunger 60. The link member 22 may be engaged with valve 20 via a screw thread (not shown) or might simply rest on an upper surface thereof and be supported by frictional engagement therewith. The upper end 22*a* of link member 22 extends into the outlet 10*b* of container 10 and is effectively located therein by inner walls 10*c* of the outlet. If necessary, upper end 22*a* may be further located within opening 10*b* by means of one or more location arms 62 shown in FIG. 1. Gas pressure from within casing 16 acts against surface 64 of valve 20 to maintain the valve in a closed position.

Alternatively, a spring 66 may be incorporated to maintain the valve in its closed position. In a first position of cap 17 (FIG. 1, FIG. 5*a*) detents 30 and 36 lie in substantially the same plane and a small gap G exists between plunger 60 and link member 22. Consequently, the valve 20 is maintained in its closed position by the pressure within casing 16 and/or spring 66. With the cap 17 in this position the container 10 and its contents 12 may be stored and/or transported without disturbing the contents thereof. A second position of cap 17 is shown in FIG. 2 and FIG. 5*b* from which it will be appreciated that outer portion 28 is depressed downwardly in the direction of arrow D such that detents 30 pass between detents 36 and are then turned radially and the detents lie one on top of one another before the outer portion 28 is released and spring 43 biases the outer portion 28 upwardly such that the detents engage each other and the plunger 60 is maintained in a depressed position. In this position, valve 20 is caused to open and gas is allowed to escape from container 16 and into the main body of liquid 12 contained within container 10. Initially, the gas will act to gassify the liquid as it rises to the surface thereof before passing into chamber 44 via aperture 34. Pressure build up within chamber 44 will cause valve 48 to operate upon build up of a predetermined pressure. This pressure is matched to that associated with sufficient gassification of the liquid for the purpose which it is intended. For example, a carbonated beverage would employ carbon dioxide gas released as bubbles into the liquid 12 such that a fizzy carbonated beverage is produced prior to dispensing. The pressure associated with sufficient carbonation is therefore important to the consumer's enjoyment of the beverage and should therefore be accurately determined for each and every beverage. Once valve 48 is opened, excess gas will escape to atmosphere via outlet 58 and upper portion 50 will indicate that the carbonation process is completed. Consequently, if the consumer merely desires a carbonated beverage he would then remove cap 17 by rotating outer portion 28 in the direction of arrow O in FIG. 5*c* such that the detents 30, 36 disengage one another and return to the same plane before engaging one another once again such that rotation of outer portion 28 causes rotation of inner portion 24 and disengagement of screw thread 26. The cap 17 may then be removed and the beverage 12 dispensed.

Alternatively, should the consumer require a pre-chilled beverage, he need merely retain the cap in its depressed position and allow additional gas to pass through the liquid thereby chilling it before passing to atmosphere via outlet 58. As the gas desorbes from the adsorbent, its temperature is considerably colder than the beverage and, hence, the chilling effect can be created. Clearly, such pre-chilling would only be necessary if it is impossible to refrigerate the beverage in a more conventional manner.

As the gas desorbs from the adsorbent, the temperature of the adsorbent falls, and this effect can also be used for chilling the beverage. In order to improve the chilling effect of the fall in the adsorbent temperature, the outer casing 16 could be made of a thin sheet of a thermally-conductive material, such as aluminium or aluminium alloy, and the outer casing could be contoured and/or provided with fins (not shown) or the like, as is known in the art, in order to assist heat transfer and thus the chilling effect.

Advantageously, the outer casing 16 is shaped and configured so as to minimise the volume therein (so far as is consistent with the requirements to contain a predetermined amount of adsorbent and to permit gas to be adsorbed and desorbed thereby) whilst maximising its surface area. This not only optimises the chilling effect resulting from the adsorbent temperature drop, but also ensures that the outer casing 16 containing the adsorbent 14 does not displace any greater volume of beverage than is strictly necessary to achieve the desired gassifying and/or chilling effect.

The outer casing 16 may be resiliently deformable, in order to allow easy insertion thereof into the container 10. This resilience is preferably sufficient to allow the inserted outer casing to expand within the container 10 so as to retain the outer casing 16 in position therein.

One of the advantages of the present invention resides in its flexibility in respect of beverage gassification and/or chilling. For example, as described above, the consumer can choose between gassification and gassification with cooling. Additionally, he can terminate one or other or both of said phases by early release of the cap. Further to this, it will be appreciated that, for containers capable of storing large quantities of beverage, the carbonating step may be initiated any one of a number of times and any remaining adsorbed gas is maintained under pressure in casing 16 by re-sealable valve 20. Indeed, the consumer need not carbonate the beverage at all and might simply choose to dispense the beverage in its stored state. Such a choice would be exercised by simply turning outer portion 28 in the direction of arrow O rather than depressing it and opening valve 20.

In some cases effective chilling of a fluid may take some time; where a canned beverage is to be chilled, for example, complete chilling thereof might take 30 seconds or more, which time is appreciable to a thirsty person. Such an individual would be grateful to know when the beverage is chilled to its optimum extent for consuming.

Accordingly, a container as described above (such as a beverage container) may also be provided with temperature reactive means adapted to give a visual indication of the temperature of the beverage.

Advantageously the temperature reactive means comprises a thermochromatic substance, such as a thermochromatic paint, or pigment, or thermochromatic liquid crystals, substances which would change colour according to their temperature and which, per se, are known in the art. Preferably, the thermochromatic substance would be in direct thermal contact with the beverage container, such that as the temperature of the beverage fell due to the operation of the chiller so would the temperature of the container and the thermochromatic substance, which substance would then change colour thus giving the consumer a visual indication that the beverage had been chilled and was ready to drink.

The thermochromatic substance is preferably applied directly to the outer surface of the beverage container, as indicated at 70 in FIG. 1, not only so as more quickly and accurately to indicate any temperature change of the beverage therein but also so as to be more easily incorporated during the container manufacturing process. Drink cans, for example, are ordinarily painted, and the addition of a further station on the can manufacturing line to apply thermochromatic paint or the like would be neither difficult nor expensive.

Although shown in FIG. 1 as a simple band applied to the outside of a can, the thermochromatic substances could equally be applied in patterns and colours to provide a significant aesthetic appeal to a consumer; so as to produce an eye-catching design or slogan, for example, when the beverage or other fluid is sufficiently chilled.

For the avoidance of doubt, the present invention encompasses not only an apparatus for cooling and/or gassifying a liquid stored in a container, but also a container comprising such an apparatus. Moreover, the principles of this invention could be employed with substances other than liquids-solid and semi-solid foodstuffs, for example, or pharmaceuticals, chemicals or the like. Similar principles could also be applicable where it is desired to gassify and heat a liquid.

What is claimed is:

1. An apparatus for cooling and/or gassifying a liquid stored in a container having an outlet, said apparatus comprising: an adsorbent, for receiving and adsorbing under pressure a quantity of gas; sealing means, for sealing said adsorbed gas in said adsorbent; and releasing means, for releasing adsorbed gas from said adsorbent in a controlled manner and directly into said liquid such that the released gas passes through the liquid thereby cooling and/or gassifying said liquid.

2. An apparatus as claimed in claim 1 in which said adsorbent is positioned within the body of liquid to be cooled and/or gassified and in which the releasing means comprises a re-sealable valve for allowing or inhibiting the flow of adsorbed gas from the adsorbent.

3. An apparatus as claimed in claim 2 including actuation means for actuating said valve.

4. An apparatus as claimed in claim 3 in which the actuation means is external of the container but operably linked to the valve which is within the container.

5. An apparatus as claimed in claim 4 in which the actuation means comprises a removable cap which also acts to seal the liquid within the container.

6. An apparatus as claimed in claim 5 in which the cap comprises a three position cap which: in its first position acts to seal the container and prevent adsorbed gas from escaping therefrom; in its second position allows gas to escape from the adsorbent and pass through any liquid within the container thereby to cool and/or gassify the liquid; and in its third position facilitates removal of the cap and hence dispensing of the liquid from the container.

7. An apparatus as claimed in claim 5 in which the cap comprises a first inner portion releasably connected to the container and a second outer portion operably connected to the first portion and movable relative thereto between said first, second and third positions.

8. An apparatus as claimed in claim 6 in which the actuation means comprises a portion of the cap itself and said portion is axially displaceable between a first position in which it acts to hold the valve in a closed position and a second position in which it acts to hold the valve in an open position.

9. An apparatus as claimed in claim 8 in which the actuation means further includes a linking member which, in operation, extends between the actuator and the valve.

10. An apparatus as claimed in claim 9 in which the second outer portion of the cap includes an abutment surface against which said linking member abuts for axial displacement therewith and hence operation of the valve.

11. An apparatus as claimed in claim 7 in which said second outer portion is axially displaceable relative to the inner portion between its first, second and third positions and further includes retaining means for retaining said second outer portion in its second position until released therefrom by an operator.

12. An apparatus as claimed in claim 11 in which said retaining means comprises a plurality of first detents projecting from an outer surface of the first portion and a plurality of second detents projecting from an inner surface of the second portion, said second detents being movable with the second portion of the cap between said first position in which they lie between the first detents and are not engaged therewith, said second position in which the second detents are axially displaced relative to the first detents and are engaged with and retained in said position by said first detents, and said third position in which said second detents abut against said first detents and facilitate rotational movement thereof upon rotational movement of said second portion, thereby to facilitate removal of the cap from the container.

13. An apparatus as claimed claim 7 including a chamber formed between said first inner and said second outer portions of the cap and a passage between the interior of the vessel and the chamber for allowing the flow of released gas thereinto, said chamber being sealed from the atmosphere by a seal between said first inner and said second outer portions of the cap.

14. An apparatus as claimed in claim 13 including a pressure relief valve for allowing for the release of gas to atmosphere upon the pressure within the chamber exceeding a pre-determined value.

15. An apparatus as claimed in claim 14 in which said valve includes a visual indicator that the valve is open and that gas is being vented to atmosphere.

16. An apparatus as claimed in claim 15 in which said visual indicator comprises a protrusion which, upon opening of the valve, protrudes beyond the outer surface of the second portion of the cap.

17. An apparatus as claimed in claim 1 in which said adsorbed gas comprises carbon dioxide.

18. An apparatus as claimed in claim 1 wherein the adsorbent is contained within a casing for placement in direct thermal contact with the liquid.

19. An apparatus as claimed in claim 18 wherein the casing is resiliently deformable.

20. An apparatus as claimed in claim 18 wherein the casing is formed of aluminum or an alloy thereof.

21. A liquid storage container comprising an adsorbent for receiving and adsorbing under pressure a quantity of gas; sealing means for releasing said adsorbed gas in said adsorbent; and releasing means for releasing adsorbed gas from said adsorbent in a controlled manner and directly into said liquid such that the released gas passes through the liquid thereby cooling and/or gassifying said liquid.

22. A liquid storage container as claimed in claim 21 comprising temperature reactive means adapted to give a visual indication of the temperature of the liquid.

23. A liquid storage container as claimed in claim 22 wherein the reactive means comprises thermochromatic paint or pigment.

24. A liquid storage container as claimed in claim 22 wherein the reactive means comprises a thermochromatic liquid crystal device or layer.

25. A liquid storage container as claimed in claim 22 wherein the reactive means is applied to the outer surface of the container.

* * * * *